US005699631A

United States Patent [19]

Tyson

[11] Patent Number: 5,699,631

[45] Date of Patent: Dec. 23, 1997

[54] ROTATABLE MAGNETIC MEMORY REMINDER DEVICE

[76] Inventor: Rogue Tyson, P.O. Box 8, Royal Oak, Mich. 48068-0008

[21] Appl. No.: 699,078

[22] Filed: Aug. 19, 1996

Related U.S. Application Data

[63] Continuation of Ser. No. 440,744, May 15, 1995, abandoned.

[51] Int. Cl.[6] ..... G09F 7/04

[52] U.S. Cl. ..... 40/621; 40/493

[58] Field of Search ..... 40/600, 373, 530, 40/494, 493, 594, 593, 597; 248/205.5, 206.2, 206.3

[56] References Cited

U.S. PATENT DOCUMENTS

| | | | |
|---|---|---|---|
| 1,531,694 | 3/1925 | Downing | 248/206.3 X |
| 2,599,047 | 6/1952 | Clark | 40/142 |
| 2,748,498 | 6/1956 | Stuart et al. | 35/28.3 |
| 2,975,539 | 3/1961 | Anderson | 40/125 |
| 3,000,115 | 9/1961 | Welch | 434/430 X |
| 3,107,442 | 10/1963 | Levine | 434/49 X |
| 3,156,056 | 11/1964 | Pribil | 40/63 |
| 3,220,132 | 11/1965 | Swiger et al. | 40/747 X |
| 3,460,276 | 8/1969 | Payne | 35/66 |
| 3,769,720 | 11/1973 | Terrones | 35/7 A |
| 4,176,478 | 12/1979 | Brewer | 40/107 |
| 4,287,676 | 9/1981 | Weinhaus | 40/10 R |
| 4,339,104 | 7/1982 | Weidman | 248/407 |
| 4,616,796 | 10/1986 | Inoue | 248/206.5 |
| 4,817,320 | 4/1989 | Fraynd | 40/621 |
| 4,834,331 | 5/1989 | Domingo | 248/205.3 |
| 5,075,991 | 12/1991 | Wenkman et al. | 40/152.1 |
| 5,203,847 | 4/1993 | Butt | 273/157 R |

FOREIGN PATENT DOCUMENTS

| | | |
|---|---|---|
| 1587188 | 11/1976 | United Kingdom . |
| 2160000 | 12/1985 | United Kingdom . |

*Primary Examiner*—Kenneth J. Dorner
*Assistant Examiner*—Cassandra Davis

[57] ABSTRACT

A rotatable memory reminder device contains a ferromagnetic plate surrounded by a decorative frame and mounted on a U-shaped stand having a base portion and two extending arms such that the magnetic plate is rotatable about an axis between the arms. The base is adapted to be mounted on a variety of surfaces with a variety of orientations, including but not limited to both horizontal and vertical surfaces. Magnetic plaques bearing reminder icons may be removably attached to either side of the plate to serve as reminders of tasks to be performed.

17 Claims, 4 Drawing Sheets

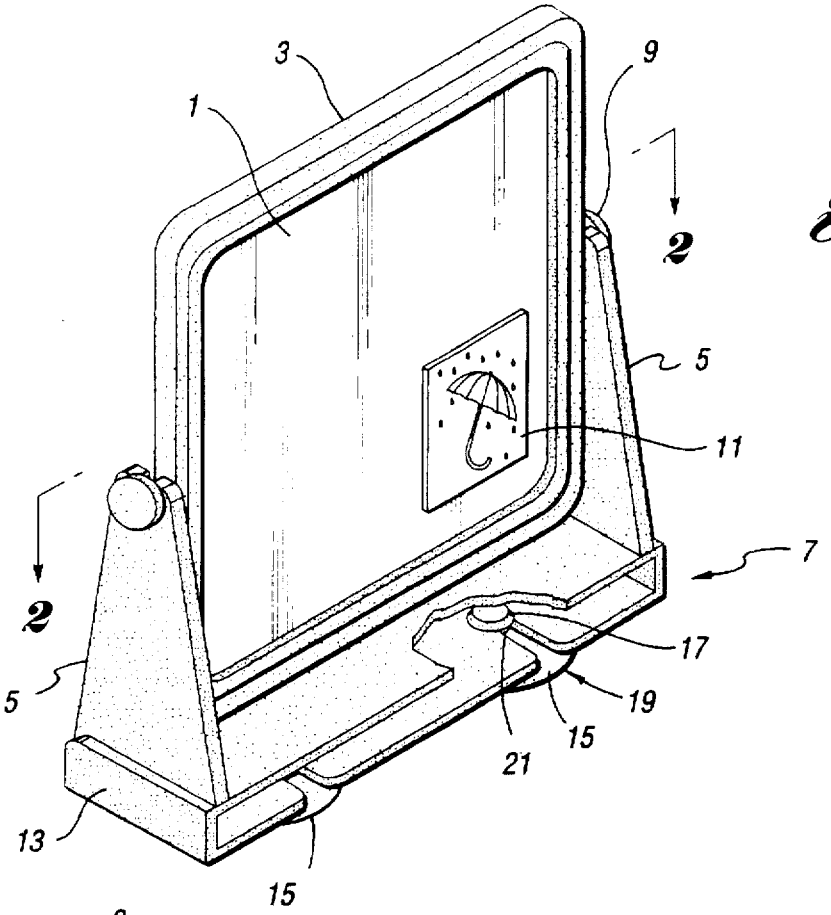
Fig. 1
Fig. 2
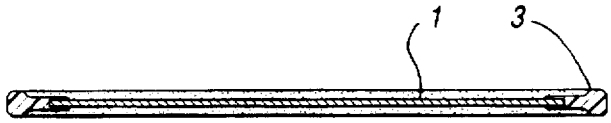
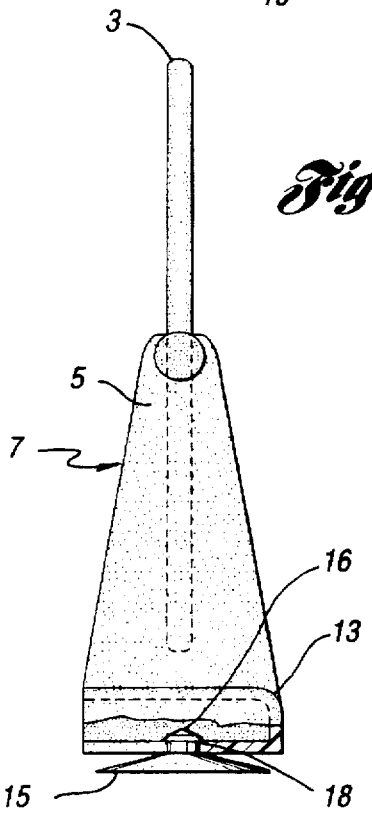
Fig. 3a
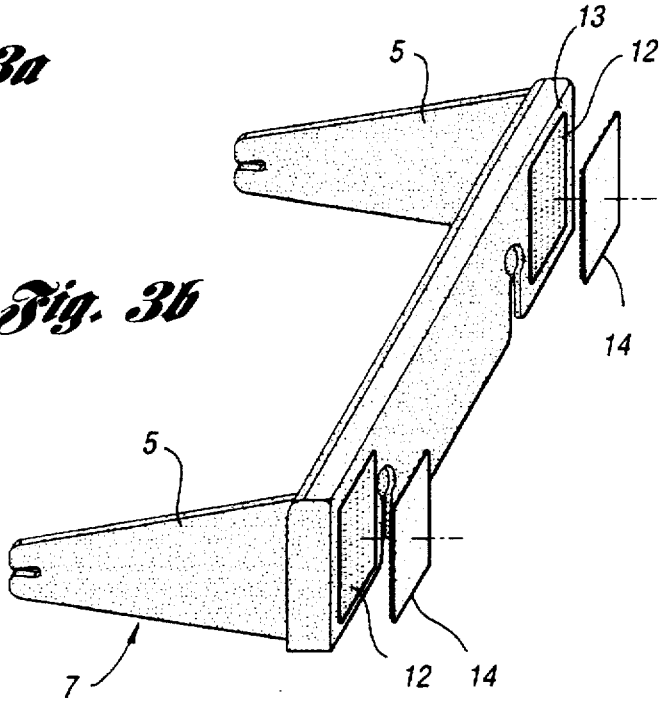
Fig. 3b

Fig. 6a
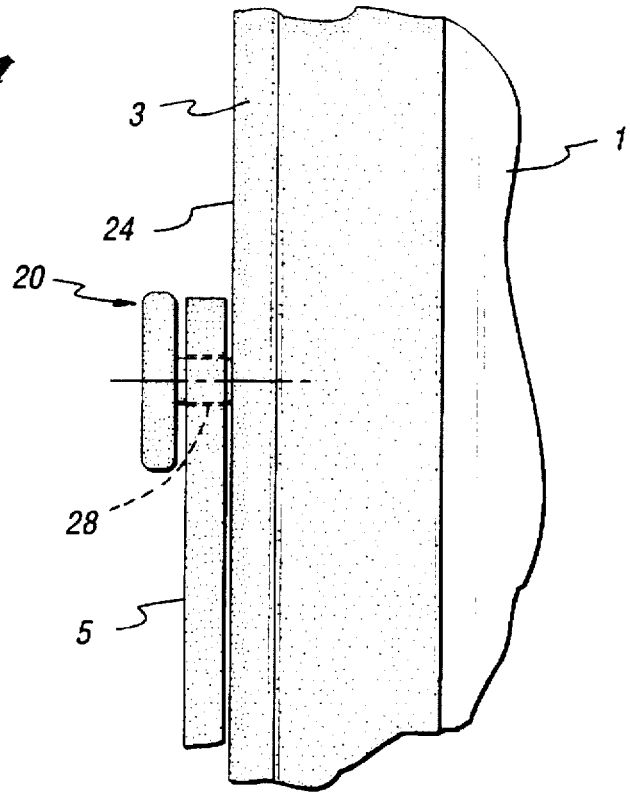
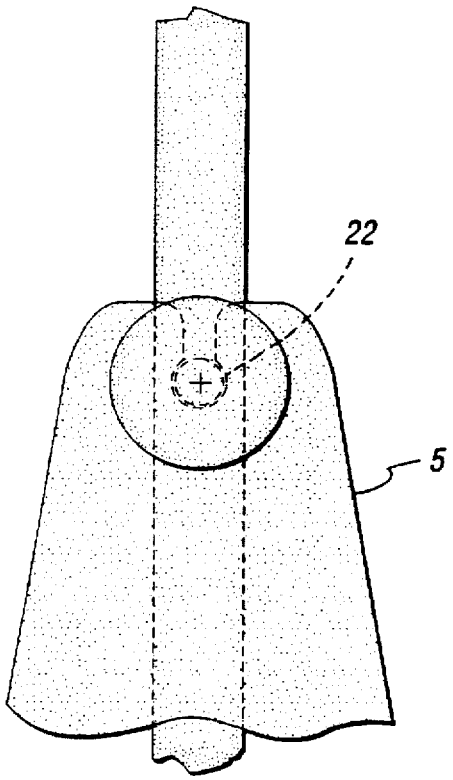
Fig. 6b
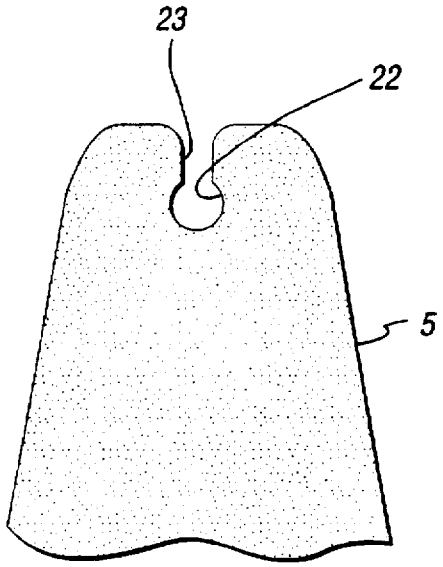
Fig. 6c

ROTATABLE MAGNETIC MEMORY REMINDER DEVICE

This is a continuation of application Ser. No. 08/440,744 filed on May 15, 1995, now abandoned.

TECHNICAL FIELD

The present invention pertains to a rotatable magnetic memory reminder device supported by a stand adapted to be mounted onto a variety of surfaces facilitating easy viewing, and which receives on either of its surfaces magnetic reminder plaques.

BACKGROUND ART

In the busy world which many people find themselves in, remembering such things as appointments, trips to the post office or bank, telephone calls, and the like becomes increasingly difficult, whether a busy executive, house person, student, or retiree. People with recognized disorders such as ADD (Attention Deficit Disorder) and ADHD (Attention Deficit Hyperactivity Disorder), senile dementia, and early stages of Alzheimer's disease have even more difficulty. Many people place considerable reliance on others, for example secretaries, spouses, parents, or children, to remind them of things they must do. Frequently, not even these agencies are sufficient to achieve satisfactory accomplishment of the desired activities. Reminder devices have been useful in aiding memory in the past, for example the ubiquitous "string around the finger". However, past devices have been limited in the extent of memory reminding provided.

A wall-mounted household reminder device having two separate display surfaces is disclosed in U.S. Pat. No. 4,817,320. Plaques having pictorial representations, or miniaturized embodiments of food items required to be purchased are reversibly attached to an underlying steel plate located behind the display surface, each plaque or miniature having a magnet bonded to its reverse side. However, the display device of the '320 patent is not readily mountable on many surfaces where its presence would be desirable, and further requires a large mounting and display area. Thus, it is not possible to mount the device on such locations as an automobile dashboard, a door jamb, or even on a busy desk surface. A similar concept is disclosed in GB 2,160,000 A.

In U.S. Pat. No. 4,287,676 is disclosed a display device utilizing both magnetic attraction and the unique properties of polymeric elastomers to attach the device securely to a ferromagnetic surface while substantially preventing lateral movement. Suitable ferromagnetic surfaces include refrigerators, filing cabinets, vehicle exteriors, and the like. Further disclosed are magnetic clips which may be removably secured to the device to hold notes, lists, etc. The use of magnetic attraction for securing the device to its desired location limits the application to ferromagnetic surfaces such as those of steel and some, but not all, stainless steels.

U.S. Pat. No. 4,176,478 discloses a calendar having numerals representing the days of the month adhered to magnetic tape in association with a grid representative of a calendar, the grid being made of non-ferrous material. The grid "blocks" have a plurality of ferrous metal tacks driven into the surface of the calendar to which the numerals are attracted. The device has a storage compartment located on the reverse side. Manufacture is rendered difficult due to the necessity of accurately providing the large number of tacks required. Moreover, the device is too large and unwieldy for placement in many desired locations.

U.S. Pat. No. 3,769,720 discloses an educational game board upon which pictorial representations of a member of various food groups are printed. A cutout playing piece having the same shape as the pictorial representation has a permanent magnet on the reverse side for a child to match with the respective representation. No mounting means is disclosed.

U.S. Pat. No. 3,156,056 discloses a ferrous metal full size control board with permanent markings on its surface, over which a transparent plastic overlay may be attached with magnetic clips. Further magnetic indicators may be placed as desired, for example to indicate sales, production or other records. The plastic overlay may be drawn upon and removed and replaced with a new sheet as desired. The board is provided with eyeholes for mounting to wall surfaces.

Other devices employing magnetic devices for information display include U.S. Pat. Nos. 2,975,539; 2,748,498; 2,599,047; and Great Britain specification 1,587,188. However, none of the display devices are suitable for readily mounted memory reminder devices.

SUMMARY OF THE INVENTION

The present invention pertains to a rotatable magnetic memory reminder device suitable for mounting in numerous, easily observable locations including both horizontal and vertical surfaces, and having icon-bearing magnetic plaques which may be removably attached to either side of the device to serve as a reminder of tasks to be performed.

BRIEF DESCRIPTION OF THE DRAWINGS

FIG. 1 illustrates one embodiment of the subject invention in perspective;

FIG. 2 illustrates a cross-section of an injection molded frame across section 2—2 of FIG. 1;

FIG. 3*a* illustrates a cross-section of the embodiment of FIG. 1 showing more clearly the base having removable suction cups as a means for mounting;

FIG. 3*b* illustrates one embodiment of a base of a memory reminder device showing hook-and-loop fasteners as a means for mounting;

FIGS. 6*a*–6*f* illustrate several means of mounting the rotatable frame into the stand.

DESCRIPTION OF THE PREFERRED EMBODIMENTS

Figure 4:
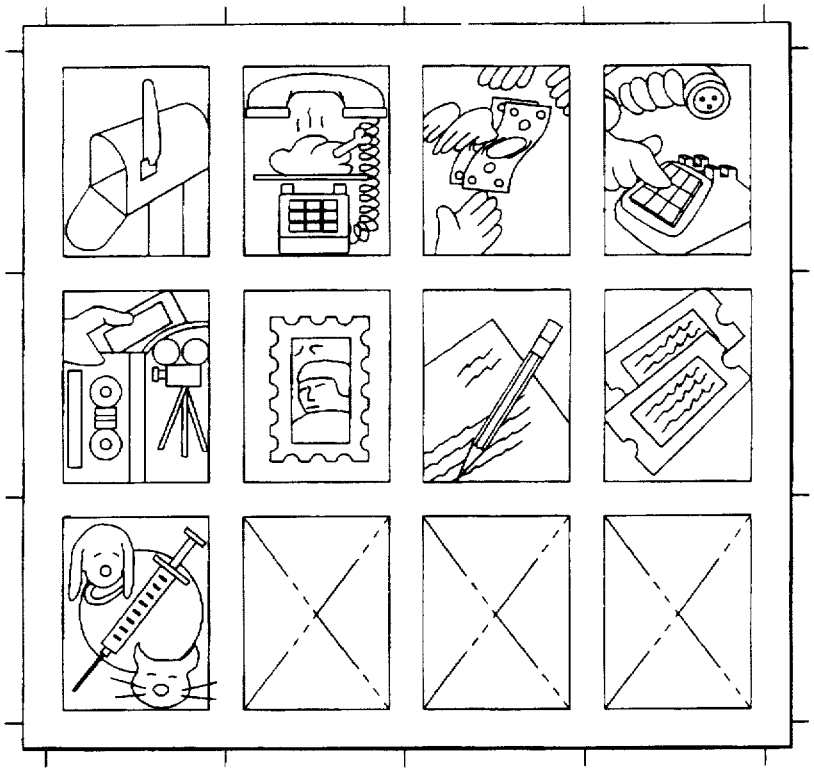
FIGS. 4 and 5 illustrate pictorial representations which may be segmented into plaques for use as icons with the memory reminder device of the subject invention.

The subject rotatable memory reminder device has a generally planar ferromagnetic plate enclosed within a decorative frame, mounted on a U-shaped stand having stand mounting means adapted to mount the device on numerous types and orientations of surfaces. The device has associated therewith a plurality of magnetic plaques bearing suitable reminder icons, suitable for removably attaching to the ferromagnetic plate.

The arrangement of the various elements and general appearance of the device may be described with reference to FIG. 1 which illustrates a perspective view of one embodiment of the subject invention device. The rotatable memory device consists of a ferromagnetic plate 1 surrounded by decorative frame 3, adapted to rotate between arms 5 of U-shaped stand 7. Preferably, the ferromagnetic plate and frame, once rotated to the desired orientation, will retain that position due to friction between the elements of the rotation means. Near the tip of arms 5 are located means 9 adapted to allow rotation of the frame. These rotation means, which also secure the frame and ferromagnetic plate to the base, are shown in greater detail in FIGS. 6*a*–6*f*. A magnetic icon, in this case a reminder to bring an umbrella, is shown at 11. The U-shaped stand 7 has a base 13 which contains stand mounting means, in this case, a pair of suction cups 15. The area 17 of the suction cups slide into tapered openings 19 and are secured in openings 21 as shown in greater detail in FIG. 3*a*. In FIG. 2, the cross-section 2—2 of FIG. 1 is shown. At 3 is the molded frame surrounding the ferromagnetic plate 1.

The ferromagnetic plate may take a number of shapes depending upon the desired aesthetic appearance, but is preferably roughly rectilinear in shape in order to utilize the surface area most effectively. By the term "ferromagnetic" is meant that the plate is capable of attracting a magnetic material. In size, the shortest side is preferably less than 10 inches, generally on the order of 3–5 inches, and most preferably about 4 inches. In the case of the latter devices, the weight is such so as to be readily mounted by a variety of techniques on a variety of surfaces, while larger size devices may be more rigidly mounted, or mounted on a horizontal supporting surface as hereinafter described. For example, a device having a ferromagnetic plate the size of c.a. 4 inches may have a total weight in the range of only 4–8 ounces, for example about 6.6 ounces.

The ferromagnetic plate may be of sheared carbon steel, for example 1010–1018 CRS (cold rolled steel), silicon steel, or ferromagnetic stainless steel and the like, and is preferably from 15 to about 50 mils thick, more preferably 20–40 mils thick, and most preferably about 35 mils thick. The thickness is not critical, and need only be such as to retain structural integrity and to provide for sufficient magnetic attraction to the magnetic icon plaques. When of a nonstainless material, the ferromagnetic plate is preferably treated to prevent rusting. Such treatment may include zinc oxiding, chromating, or other protection such as painting, plating with chrome, copper, nickel or other metal, or enameling. The plating may advantageously be 0.0002 thick zinc oxide, for example.

The periphery of the magnetic plate is surrounded by a decorative frame which further contains plate rotational mounting means. The protrusion of the frame beyond the plane of the magnetic plate further serves to prevent the icon-bearing plaques from sliding off, particularly when the plaques are stacked one above the other. The decorative frame may have any desired cross-sectional shape and thickness, and is preferably of injection molded polymer such as polystyrene, preferably high impact polystyrene (HIPS), polyacrylate, polyacetal, and the like. The magnetic plate may be positioned in a suitable mold and polymer injected around the plate periphery, or the frame may comprise a plurality of sections which may be bonded together by known bonding techniques, for example solvent bonding, adhesive bonding, thermal bonding, ultrasonic welding, and the like. The frame preferably encompasses the entire periphery of the magnetic plate. However, it is within the scope of the invention to enclose only those peripheral portions on opposite edges of the magnetic plate as are necessary to secure the rotational mounting means to the plate. Thus, the frame may extend, for example, for one-third to two-thirds of each of the opposed edges of a ferromagnetic plate, or less. It is preferable for a frame portion to surround the top and bottom edges of the ferromagnetic plate to ensure that the magnetic plaques will not slide off. This function may also be achieved by suitable lips on the ferromagnetic plate itself.

For higher end devices suitable for offices, etc., requiring a more aesthetic rather than functional appearance, the frame may be machined of wood or stone. For example, the frame may comprise oak, maple, walnut, cherry, mahogany, wenge, bubinga, teak, rosewood, ebony, or other wood species, or agate, onyx, marble, granite, etc. Frames of metals such as silver, gold, nickel, plated metals, or composite frames containing one or more of the foregoing, for example rosewood and silver are also contemplated. Preferably, however, the frame is of injection molded plastic.

The frame includes a rotatable mounting means which allows the magnetic plate to be rotated with respect to the U-shaped stand to any desired angle, thus presenting alternative sides of the magnetic plate to the user. The particular rotatable mounting means is not critical, but a preferred rotatable mounting means is shown in FIGS. 6*a*–6*c*, and consists of a knob-shaped projection 20 projecting from the outermost edge 24 of frame 3. The shank 28 of the projection 20 is of a length and diameter such that the shank is a snap-fit in mounting hole 22 of the arms 5 of the stand, the tension provided by this snap-fit supplying sufficient friction to maintain the ferromagnetic plate and frame at the desired rotational angle. The arm and hole are shown in greater detail without the coacting projection in 6*c*. Rather than the tension supplying the necessary rotation-maintaining friction, the interior of the mounting hole and exterior of the shank may have a plurality of teeth extending in a direction away from the frame in the plane of the frame. The teeth will thus provide for stable positioning in small angular increments.

Figure 6D:
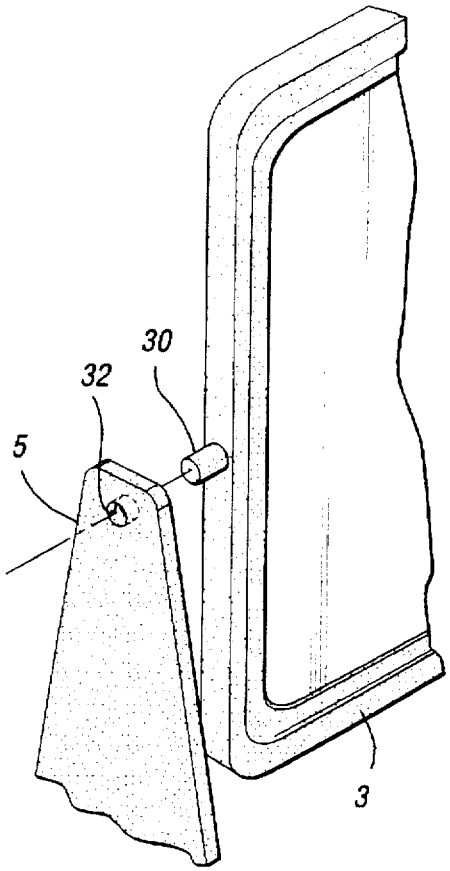

In a further preferred rotatable mounting means, as shown in an exploded view in FIG. 6*d*, the opposed edges of the frame have simple cylindrical projections 30. In such a case, the corresponding holes 32 in the arms 5 of the U-shaped stand need not be interrupted to allow the mounting pin to snap into position, but rather, the frame may be temporarily distorted by bending the arms away from each other and inserting the mounting pins into their respective receiving holes.

Figure 6E:
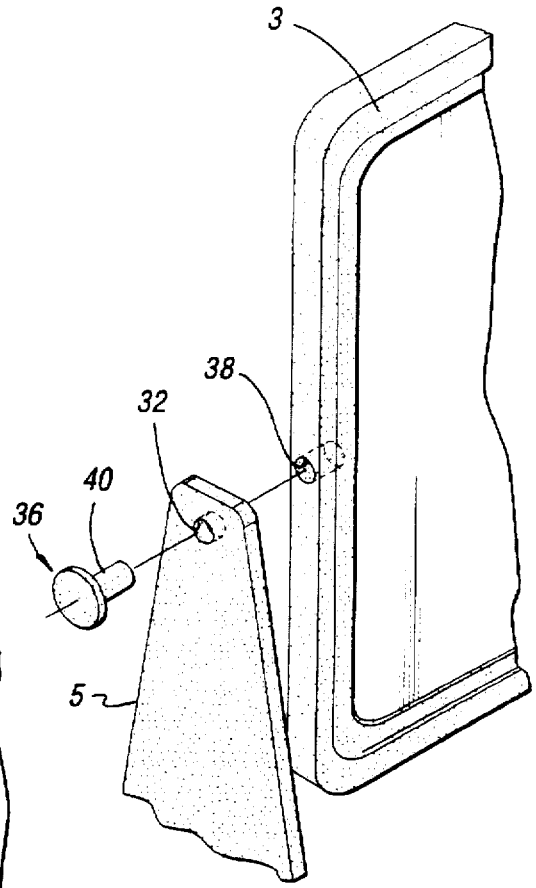
Figure 6F:
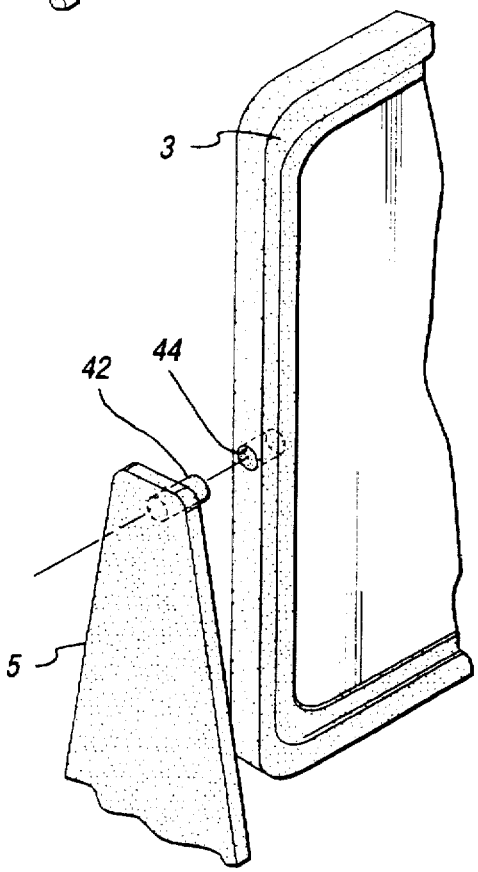

A further rotatable mounting means is disclosed in FIG. 6*e* in exploded view. Here, a knob-shaped pin 36 is inserted through a hole 32 in the arm 5 of the stand into a recess 38 in the frame. The shank 40 of the pin may be press-fit into the receiving hole in the frame, may be adhesively bonded to the hole in the frame, or may be screwed into the frame. Other equivalent mounting means will suggest themselves to those skilled in the art.

The stand is a generally U-shaped stand in accordance with FIG. 1. The stand comprises a base 13, and two preferably parallel extending arms 5 the length of which are longer than one-half the edge of the magnetic plate to be rotated about the arms, thus allowing full rotation of the plate. Each arm contains a rotatable mounting coacting means adapted to coact with the rotatable mounting means of the frame to allow for rotation of the latter and the enclosed ferromagnetic plate. Thus, with respect to FIGS. 6*a*–6*c*, the rotatable mounting coacting means comprises a circular passage 22 located proximate the end of the arm 5, the circumference of the hole interrupted by a passage 23 extending to the surface of the arm allowing the shank of a knob-shaped rotatable mounting means 20 to enter and snap into position within the hole.

With respect to FIG. 6*d*, the rotatable mounting coacting means comprises a cylindrical hole 32 which may pass partially through, or totally through the arm 5 as shown, and dimensioned to receive a projecting pin 30 emanating from the frame. With respect to FIG. 6*e*, the rotatable mounting coacting means comprises a through cylindrical or other shaped hole 32 of a size such that the plain or threaded shank of a knob-shaped pin 36 may pass through and be positioned within or screwed into a receiving hole 38 in the frame. With respect to FIG. 6*f*, the rotatable mounting coacting means comprises a projecting pin 42 molded integrally with the stand arm 5 or subsequently attached thereto, of a size suitable to be inserted into a rotatable mounting means in the frame 3 consisting of a hole 44 located therein.

The base 13 of the stand 7 incorporates stand mounting means. The stand mounting means is preferably one which enables ready attachment of the stand to the desired surface but which permits ready removal as well. Preferred stand mounting means comprise adhesive strips, suction cup(s) and hook-and-loop fasteners. For example, a preferred stand mounting means consists of a pair of suction cups as shown in FIG. 1 and in cross-section in FIG. 3*a*. The suction cups may be of known elastomeric materials such as synthetic or natural rubber, synthetic elastomers, and the like. Santoprene® elastomer is preferred. In FIG. 1, the base 13 of the U-shaped stand 7 is hollow and contains tapered openings 19 which terminate in round holes 21. A suction cup 15, having on its non-suction top surface a projecting ball or knob 16 (FIG. 3*a*) extending from a shank portion 18 (FIG. 3*a*) slides into the tapered slot, the shank snapping into the round hole 21 at the end of the tapered hole in the base and being prevented from being easily removed by the knob which is larger in size than the hole into which the shank is retained.

If the memory reminder device is to be attached to a sloping or vertical surface, two suction cups are preferred. However, in the case of units designed to be mounted on horizontal surfaces, it may be possible to utilize but one suction cup. In such cases, it may be desirable to increase the size of the base to promote stability, however wobbling and rotation of the base is likely in such cases. The depth of the base is normally from about 20% to 100% the vertical depth of the magnetic plate, and is thickness may vary from a small fraction of an inch, to over one inch in larger devices.

A second preferred mounting means, as illustrated in FIG. 3*b*, is the so-called hook-and-loop fastener, manufactured under the trade name VELCRO®, for example. In this method, the stand base is generally flat, and one or more hook or loop portions 12 mounted thereon, for example by means of a pressure-sensitive or contact adhesive. The same base as illustrated in FIG. 3*a* may be used, with the suction cups removed. The counterpart loop or hook portion 14 of the fastener is then similarly adhesively bonded to the surface on which the memory reminder device is to be attached, for example a car dashboard or window, the door frame of a residence of office, desk surface, or other location. The positioning of the hook-and-loop fasteners may be such that the device may be dismounted and mounted with suction cups or additional hook-and-loop fasteners or similar devices to another surface.

When semi-permanent mounting is envisioned, pressure sensitive adhesive strips bearing adhesive on both surfaces may be used. Suitable strips, generally with a foam or resilient elastomeric interior, adhesive on both exterior surfaces, and release paper covering the adhesive, are commercially available and are used, for example, to secure picture frames to walls. An example of the latter is SCOTCH® VHB tape, available from the 3M Company. Additional stand mounting means include magnets, for example flexible elastomeric sheet magnets or individual bar magnets when mounting to a ferromagnetic surface is desired, or a gravity mounting means comprising a base weighted to such an extent that when placed on a horizontal surface, the device will be substantially resistant to tipping over. In such cases, an elastomeric bottom portion covering all or a portion of the base is desirable to augment stable positioning and prevent marring of the surface on which the device is to be mounted.

The magnetic plaques carrying icons symbolizing items or activities may be of varying size and shape, but are advantageously square or rectilinear for ease of manufacturing. The material of construction may be flexible or rigid, but is preferably a flexible elastomeric product containing a magnetic material, for example a ferrite such as strontium ferrite, barium ferrite or other magnetic material. Sheets of such material are commercially available, for example available from The Reliance Group of Michigan, Farmington Hills, Mich. A thickness of from 15 to 70 mils, preferably 25–40 mils, and most preferably about 30–35 mils is suitable. The preferred magnetic sheeting contains 65–70 vol% strontium ferrite powder in a synthetic rubber binder, with an acrylic pressure sensitive adhesive on one surface. This adhesive is used to bond a laminate suitable for imprinting icons, for example a top-coated satin matte vinyl or Krome Koat paper. The magnet, adhesive, and laminate weight, for example, about 0.567 lbs/ft$^2$ at 35 mil thickness.

The icons may be printed directly upon the magnetic sheet material which may then be scored with a knife edge, i.e., "kiss-cut", to be broken apart by the purchaser, or cut apart with scissors. Alternatively, the icons may be separately printed upon a paper or polymer film and adhesively bonded to the magnetic material. A paper or film bearing a film adhesive, pressure sensitive or contact adhesive, or thermally activated adhesive may also be used. Preferably, a number of blank plaques may be included in order that customized icons may be developed by the user. The plaques adhere magnetically to the ferromagnetic rotatable plate, and may be easily moved from one side to the other at will, or stacked atop already positioned plaques. The shape of the individual plaques is generally rectilinear, and the size is dependent upon the number of plaques desired to be used at a given time and the size of the ferromagnetic plate. For usual purposes, plaques of about 1 inch square or 0.75 inch by 1 inch rectangular shape are suitable. Plaques may also be of other geometrical shapes, preferably shapes which are mutually compatible, i.e., stackable, such as triangles, hexagons, or the like.

Figure 5:
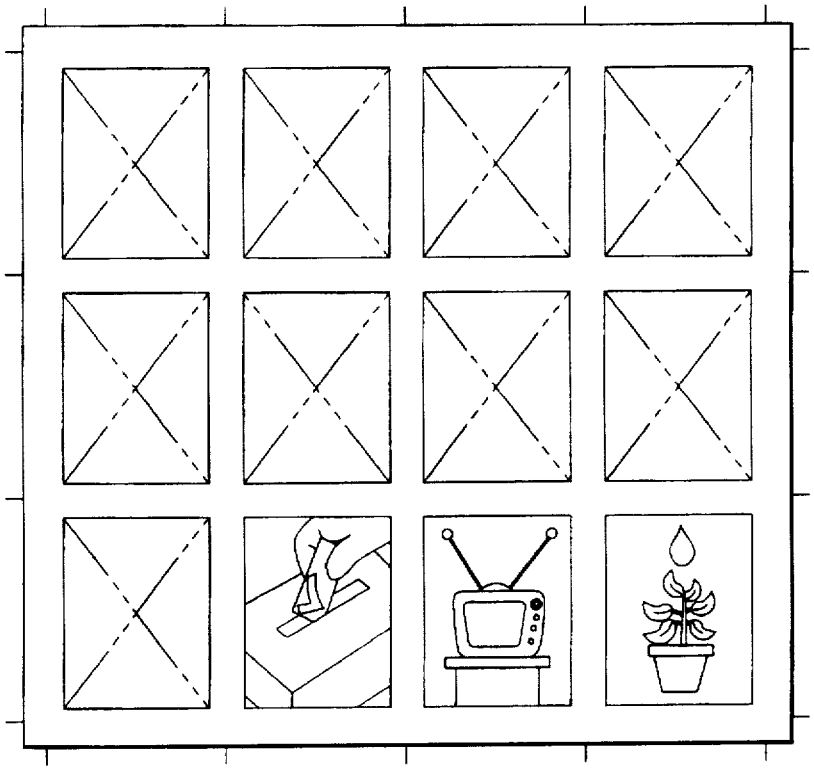

The icons utilized may vary considerably, with representative icons depicted in FIGS. 4 and 5. The icons are preferably polychromatic.

Having now fully described the invention, it will be apparent to one of ordinary skill in the art that many changes and modifications can be made thereto without departing from the spirit or scope of the invention as set forth herein.

What is claimed is:

1. A rotatable magnetic memory reminder device, comprising:

a) a substantially planar ferromagnetic plate having a periphery;

b) a decorative frame surrounding at least a portion of the periphery of said ferromagnetic plate, said at least a portion of the periphery including minimally two portions located on opposed edges of said ferromagnetic plate;

c) rotatable mounting means positioned on portions of said decorative frame located on opposed edges of said ferromagnetic plate;

d) a generally U-shaped stand, said stand having a flat base portion and two extending arm portions, said flat base portion comprising a hollow rectilinear shape having substantially parallel top and bottom members orthogonal to said extending arm portions, a plurality of side members connecting said top and bottom members, one side of said rectilinear shape having no side member such that a hollow space defined by said top and bottom members and said plurality of side members is exposed, said bottom member adapted to receive a primary stand mounting means comprising at least one rubber suction cup, the bottom member optionally further adapted to receive on its surface most remote from said extended arm portions, a secondary stand mounting means;

e) rotatable mounting coacting means located proximate an end of each of said extending arm portions of said stand, said rotatable mounting coacting means coacting with said rotatable mounting means to provide full rotational capability of said ferromagnetic plate relative to said stand;

f) stand mounting means, said stand mounting means located proximate said base portion of said stand, said stand mounting means selected from the group consisting of a primary stand mounting means and a secondary stand mounting means; and g) a plurality of magnetic plaques, each bearing an icon.

2. The device of claim 1 wherein said primary stand mounting means comprises at least one elastomeric suction cup mounted to said bottom member of said hollow rectilinear shape of said base portion of said stand by insertion into a receiving slot in said bottom member.

3. The device of claim 1 wherein said bottom member is adapted to receive a secondary stand mounting means, and wherein said secondary stand mounting means comprises at least one set of hook-and-loop fasteners, one member of each of said at least one set of hook-and-loop fasteners adhesively bonded to said base portion.

4. The device of claim 1 wherein said bottom member is adapted to receive a secondary stand mounting means, and wherein said secondary stand mounting means comprises at least one adhesive strip.

5. The device of claim 1 wherein said decorative frame comprises a molded polymer frame.

6. The device of claim wherein said decorative frame surrounds the entire periphery of said ferromagnetic plate.

7. The device of claim 5 wherein said decorative frame surrounds the entire periphery of said ferromagnetic plate.

8. The device of claim 1 wherein said rotatable mounting means comprises a pair of projections extending outwardly away from said decorative frame substantially in the plane of said ferromagnetic plate.

9. The device of claim 8 wherein said rotatable mounting coacting means comprises a pair of recesses, one of said recesses located in each of said arms, said recesses adapted in shape and size to receive said pair of projections extending from said frame.

10. The device of claim 1 wherein said rotatable mounting means comprises a pair of recesses in said decorative frame, said recesses being on opposed sides of said ferromagnetic plate and substantially in the plane of said plate.

11. The device of claim 10 wherein said rotatable mounting coacting means comprises a pair of projections extending inwardly from said arm portions, one of said pair of projections positioned on each arm portion, said projections adapted in size and shape to enter said recesses in said frame.

12. The device of claim 10 wherein said rotatable mounting coacting means comprises a pair of holes in said arm portions, each of said arm portions bearing one of said holes, and a pair of positioning pins adapted in size and shape to pass through said holes in said arm portions and into said recesses in said frame.

13. The device of claim 1 wherein said magnetic plaques comprise an elastomeric magnetic sheet material.

14. The device of claim 1 wherein said rotatable mounting means comprises a pair of knob-shaped pins extending outwardly from opposed sides of said frame, each of said knob-shaped pins having a shank portion located mediate a knob portion of said knob-shaped pin and said frame, each of said arm portions having a circular through hole and a slot extending radially outward from said through hole to a periphery of said arm portion, said slot and said through hole adapted in size such that said shank of said knob-shaped pins may be pressed through said slot and snapped into said through hole, said knob portions of said knob-shaped pins positioned on the side of said arm portions most remote from said frame.

15. The device of claim 1 wherein said frame comprises a material selected from the group consisting of wood and stone.

16. The device of claim 1 wherein said base portion has a weight sufficient to maintain said device in a stable position when mounted on a horizontal surface.

17. The device of claim 1 wherein said rotatable mounting means and said rotatable mounting coacting means between them supply sufficient friction to maintain said ferromagnetic plate and said frame at any desired rotational angle with respect to said stand.

* * * * *